US011108173B2

(12) United States Patent
Okada

(10) Patent No.: US 11,108,173 B2
(45) Date of Patent: Aug. 31, 2021

(54) COAXIAL CONNECTOR AND COAXIAL CONNECTOR INCORPORATING COAXIAL CABLES

(71) Applicant: Murata Manufacturing Co., Ltd., Kyoto-fu (JP)

(72) Inventor: Daisuke Okada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/805,566

(22) Filed: Feb. 28, 2020

(65) Prior Publication Data

US 2020/0203861 A1 Jun. 25, 2020

Related U.S. Application Data

(63) Continuation of application No. PCT/JP2018/031947, filed on Aug. 29, 2018.

(30) Foreign Application Priority Data

Sep. 1, 2017 (JP) ..... JP2017-168848

(51) Int. Cl.
*H01R 9/05* (2006.01)
*H01R 13/639* (2006.01)
*H01R 103/00* (2006.01)

(52) U.S. Cl.
CPC ..... *H01R 9/0518* (2013.01); *H01R 13/639* (2013.01); *H01R 2103/00* (2013.01)

(58) Field of Classification Search
CPC . H01R 9/0518; H01R 13/639; H01R 2103/00
(Continued)

(56) References Cited

U.S. PATENT DOCUMENTS 4,269,469 A * 5/1981 Audic ..... H01R 9/0518 439/424
6,325,681 B1 * 12/2001 Doi ..... H01R 13/112 439/495

(Continued)

FOREIGN PATENT DOCUMENTS

JP H08-315922 A 11/1996
JP 2000-040539 A 2/2000

(Continued)

OTHER PUBLICATIONS

International Search Report issued in PCT/JP2018/031947; dated Oct. 23, 2018.

(Continued)

*Primary Examiner* — Alexander Gilman
(74) *Attorney, Agent, or Firm* — Studebacker & Brackett PC

(57) ABSTRACT

A coaxial connector includes internal and external terminals, and an insulation member disposed between the terminals. The external terminal includes a holding portion that holds coaxial cables, and crimping portions. A crimping portion outermost in an arrangement direction of the cables is formed from a plate member bent to follow an outer circumference of the cable, and includes a connection portion connectable with the holding portion between both end portions in the arrangement direction. An inner hook extends inward in the arrangement direction from a point of intersection between the connection portion connectable with the holding portion and a virtual straight line orthogonal to the arrangement direction and passing a center of the cable, in a cross-sectional view orthogonal to a longitudinal direction of the cable. An outer hook extends outward in the arrangement direction from the point of intersection. The inner hook is shorter than the outer hook.

18 Claims, 7 Drawing Sheets

(58) Field of Classification Search
USPC ..... 439/585
See application file for complete search history.

(56) References Cited

U.S. PATENT DOCUMENTS 6,364,701 B1 * 4/2002 O'Sullivan ..... H01R 13/6592 439/579
7,867,027 B2 * 1/2011 Sakaguchi ..... H01R 4/184 439/585
8,043,114 B2 * 10/2011 Kaneko ..... H01R 12/716 439/497
8,277,249 B2 * 10/2012 Koga ..... H01R 4/185 439/585
9,236,666 B2 * 1/2016 Matsushita ..... H01R 4/183
9,287,643 B2 * 3/2016 Yoshida ..... H01R 12/75
9,450,340 B2 * 9/2016 Uratani ..... H01R 13/6585
10,573,987 B2 * 2/2020 Osaki ..... H01R 12/71
2015/0357729 A1 12/2015 Uratani et al.
2015/0364843 A1 * 12/2015 Yamauchi ..... H01R 9/0518 439/394

FOREIGN PATENT DOCUMENTS

JP 2015-106558 A 6/2015
JP 2015-162351 A 9/2015

OTHER PUBLICATIONS

International Preliminary Report on Patentability and Written Opinion ssued in PCT/JP2018/031947; dated Mar. 3, 2020.
An Office Action mailed by the Korean Intellectual Property Office dated Apr. 16, 2021, which corresponds to Korean Patent Application No. 10-2020-7003436 and is related to U.S. Appl. No. 16/805,566 with English anguage translation.

* cited by examiner

COAXIAL CONNECTOR AND COAXIAL CONNECTOR INCORPORATING COAXIAL CABLES

CROSS-REFERENCE TO RELATED APPLICATIONS

This application claims benefit of priority to International Patent Application No. PCT/JP2018/031947, filed Aug. 29, 2018, and to Japanese Patent Application No. 2017-168848, filed Sep. 1, 2017, the entire contents of each are incorporated herein by reference.

BACKGROUND

Technical Field

The present disclosure relates to a coaxial connector and a coaxial connector incorporating coaxial cables.

Background Art

Japanese Unexamined Patent Application Publication No. 2015-106558 discloses an example of a coaxial connector of this type.

An existing coaxial connector includes an internal terminal (socket) connected to a central conductor of a coaxial cable, an external terminal (housing) connected to an outer conductor of the coaxial cable, and an insulation member (bushing) disposed between the internal terminal and the external terminal. A crimping portion for fixing the coaxial cable is disposed on the external terminal.

SUMMARY

Parallel connection of two or more coaxial cables to one coaxial connector is desired. Conceivable examples of a structure that achieves this desire include a structure where two or more crimping portions are disposed on an external terminal and each of the crimping portions fixes one coaxial cable.

In an existing structure of crimping portions, however, reduction of the space between the crimping portions adjacent to each other is limited, and the space still has room for improvement in view of suppressing a size increase of a coaxial connector.

Thus, the present disclosure provides a coaxial connector allowing multiple coaxial cables to be connected thereto in parallel and concurrently suppressing size increase, and to provide a coaxial connector including the coaxial cables.

A coaxial connector according to the present disclosure is a coaxial connector allowing a plurality of coaxial cables to be connected thereto in parallel, the coaxial cables each including a central conductor and an outer conductor surrounding the central conductor. The connector includes an internal terminal connected to the central conductor of each of the plurality of coaxial cables, an external terminal connected to the outer conductor of each of the plurality of coaxial cables, and an insulation member disposed between the internal terminal and the external terminal. The external terminal includes a holding portion that holds the plurality of coaxial cables, and a plurality of crimping portions disposed to correspond to the plurality of coaxial cables. A crimping portion corresponding to at least one of two coaxial cables disposed outermost in an arrangement direction of the plurality of coaxial cables is formed from a plate member bent to follow an outer circumference of the coaxial cable.

The crimping portion includes a connection portion connectable with the holding portion at a portion between both end portions in the arrangement direction of the plurality of coaxial cables. The crimping portion includes an inner hook and an outer hook. The inner hook extends inward in the arrangement direction from a point of intersection between the connection portion connectable with the holding portion and a virtual straight line orthogonal to the arrangement direction and passing a center of the coaxial cable, in a cross-sectional view orthogonal to a longitudinal direction of the coaxial cable. The outer hook extends outward in the arrangement direction from the point of intersection. The inner hook is shorter than the outer hook.

A coaxial connector according to the present disclosure allows a plurality of coaxial cables to be connected thereto in parallel and suppresses a size increase.

DETAILED DESCRIPTION (Findings on which Present Disclosure is Based)

The inventors of the present disclosure have diligently studied to suppress a size increase of a coaxial connector that allows a plurality of coaxial cables to be connected thereto in parallel, and have obtained the following findings.

In an existing coaxial connector, a crimping portion is formed by bending a single plate member into a U-shape in cross section from a center in the longitudinal direction as the origin. Also when a plurality of crimping portions are formed at an external terminal, it is advantageous in various viewpoints including productivity that a plurality of crimping portions are formed by cutting and bending a single plate member.

Figure 10:
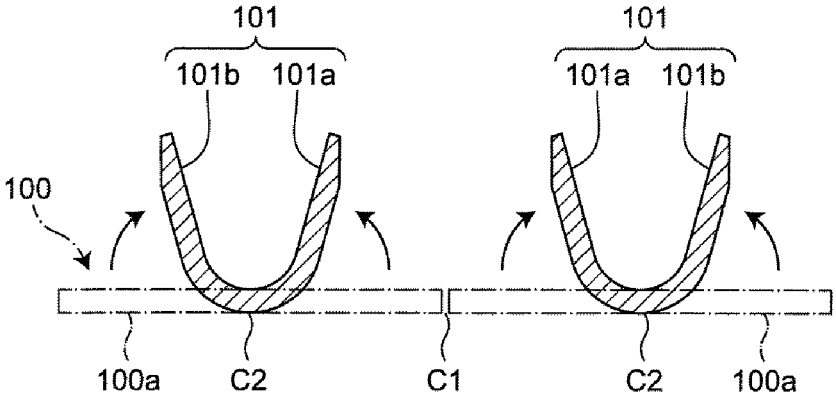
FIG. 10 is a cross-sectional view of the state where two crimping portions having an existing structure are formed from a single plate member.

As illustrated in FIG. 10, to form two crimping portions 101 from a single plate member 100, the single plate member 100 may be cut at a center C1 in the longitudinal direction to form plate members 100*a*, and the plate members 100*a* thus obtained by cutting may be bent into a U-shape in a cross section from their centers C2 in the longitudinal direction as the origin. In this case, however, a space corresponding to the developed length of the crimping portions 101 is left between the crimping portions 101 adjacent to each other. Thus, the space between the crimping portions 101 adjacent to each other fails to be reduced.

To address this, the inventors of the present disclosure have found a way to reduce the space between the crimping portions 101 adjacent to each other by forming inner hooks 101*a* of the crimping portions 101 shorter than outer hooks 102*b*. Based on this new finding, the inventors of the present disclosure have arrived at the disclosure, below.

A coaxial connector according to an aspect of the present disclosure is a coaxial connector allowing a plurality of coaxial cables to be connected thereto in parallel, the coaxial cables each including a central conductor and an outer conductor surrounding the central conductor. The connector includes an internal terminal connected to the central conductor of each of the plurality of coaxial cables, an external terminal connected to the outer conductor of each of the plurality of coaxial cables, and an insulation member disposed between the internal terminal and the external terminal. The external terminal includes a holding portion that holds the plurality of coaxial cables, and a plurality of crimping portions disposed to correspond to the plurality of coaxial cables. A crimping portion corresponding to at least one of two coaxial cables disposed outermost in an arrangement direction of the plurality of coaxial cables is formed from a plate member bent to follow an outer circumference of the coaxial cable. The crimping portion includes a connection portion connectable with the holding portion at a portion between both end portions in the arrangement direction of the plurality of coaxial cables. The crimping portion includes an inner hook and an outer hook. The inner hook extends inward in the arrangement direction from a point of intersection between the connection portion connectable with the holding portion and a virtual straight line orthogonal to the arrangement direction and passing a center of the coaxial cable, in a cross-sectional view orthogonal to a longitudinal direction of the coaxial cable. The outer hook extends outward in the arrangement direction from the point of intersection. The inner hook is shorter than the outer hook.

This structure allows a plurality of coaxial cables to be connected thereto in parallel, and prevents a size increase of a coaxial connector by reducing the space between crimping portions adjacent to each other.

The inner hook may be shorter than a half of the outer circumference of each of the coaxial cables, and the outer hook may be longer than the half of the outer circumference of each of the coaxial cables. In this structure, in the state where the crimping portion is crimping the coaxial cable, the free end portions of the inner hook and the outer hook are disposed to the inner side, in the arrangement direction of the coaxial cables, of the virtual straight line. As described above, this structure can reduce the space between crimping portions adjacent to each other. This structure can thus prevent the free end portion of the inner hook or the free end portion of the outer hook from becoming caught on something and from cancelling crimping.

The inner hook may be longer than or equal to a quarter of the outer circumference of each of the coaxial cables. Thus, to fix the coaxial cable using the crimping portion, this structure can restrict the lateral movement of the coaxial cable, and facilitate manufacture of the coaxial connector.

A total length of the inner hook and the outer hook may be equal to a length of the outer circumference of each of the coaxial cables. In this structure, the contact area between the coaxial cable and the crimping portion can be increased and the coaxial cable can be held more highly reliably. The crimped coaxial cable eliminates the need of excessively compressing the coaxial cable and deforming the cross-sectional shape, and thus prevents the characteristic impedance from varying due to deformation of the cross-sectional shape of the coaxial cable and prevents electric characteristics from being lowered. Herein, "equal" includes the meaning of being substantially equal besides being completely equal in view of, for example, manufacturing tolerance.

The coaxial connector may allow two coaxial cables to be connected thereto in parallel, and the inner hook of the crimping portion corresponding to one of the coaxial cables may be adjacent to the inner hook of the crimping portion corresponding to the other coaxial cable. This structure enables a coaxial connector that allows two coaxial cables to be connected thereto in parallel to further suppress a size increase.

At least one of crimping portions disposed outermost in the parallel direction of the plurality of crimping portions may include, at at least one of free end portions of the inner hook and the outer hook, an inclined portion where an inner surface of the crimping portion facing the outer circumference of the coaxial cable is inclined toward an outer surface opposite to the inner surface as the inner surface extends toward the at least one free end portion. In this structure, when the crimping portions crimp the coaxial cables, the coaxial cables are prevented from being damaged by at least one of the free end portions of the inner hooks and the outer hooks.

A coaxial connector incorporating coaxial cables according to an aspect of the present disclosure includes the coaxial connector and the plurality of coaxial cables connected in parallel to the coaxial connector. This structure can reduce the space between the crimping portions adjacent to each other and prevent a size increase of the coaxial connector.

The crimping portion may crimp the outer conductor. This structure secures electrical connection between the external terminal and the outer conductor of the coaxial cable via the crimping portion.

The coaxial cable may include an insulating coating surrounding an outer conductor. The crimping portion may crimp the outer conductor and the insulating coating. In this structure, the contact area between the coaxial cable and the crimping portion can be increased and the coaxial cable can be held more highly reliably.

Embodiments of the present disclosure will be described below with reference to the drawings. The present disclosure is not limited to these embodiments. Throughout the drawings, components substantially the same are denoted with the same reference signs.

For illustration convenience, the terms representing directions such as "upward", "downward", "lateral", and "oblique", will be used below. However, these terms do not limit, for example, the states of use of a coaxial connector according to the present disclosure.

Embodiments

Figure 1:
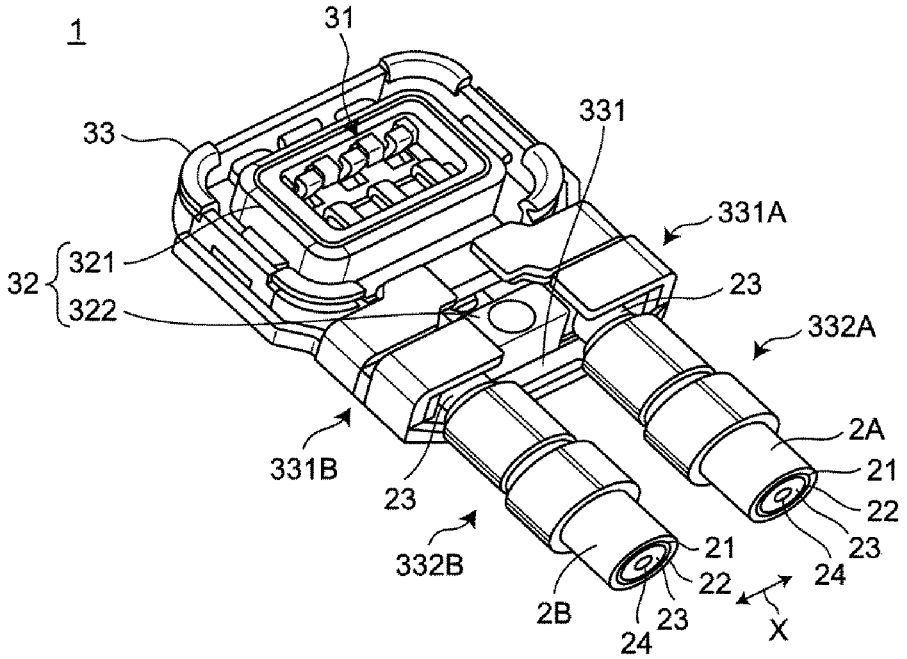
FIG. 1 is a perspective view of a schematic structure of a coaxial connector incorporating coaxial cables according to an embodiment of the present disclosure.
Figure 2:
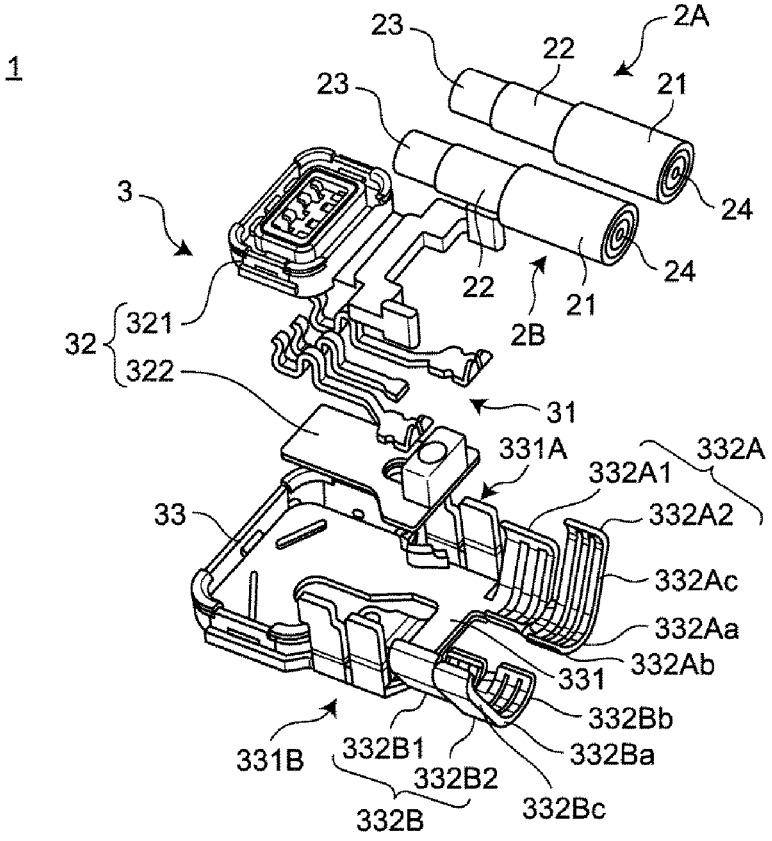
FIG. 2 is an exploded perspective view of the coaxial connector incorporating coaxial cables of FIG. 1.

FIG. 1 is a perspective view of a schematic structure of a coaxial connector incorporating coaxial cables according to an embodiment of the present disclosure. FIG. 2 is an exploded perspective view of the coaxial connector incorporating coaxial cables of FIG. 1. Hereinbelow, the coaxial connector incorporating coaxial cables is referred to as a "plug cable".

As illustrated in FIG. 1 and FIG. 2, a plug cable 1 includes coaxial cables 2A and 2B and a coaxial connector 3.

The coaxial cable 2A and the coaxial cable 2B have the same structure. As illustrated in FIG. 2, the coaxial cables 2A and 2B each include an insulating coating 21, an outer conductor 22, an insulation member 23, and a central conductor 24. The insulation member 23 surrounds the central conductor 24. The outer conductor 22 surrounds the insulation member 23. The insulating coating 21 surrounds the outer conductor 22. The insulating coating 21, the outer conductor 22, and the insulation member 23 are tubular.

At the leading ends of the coaxial cables 2A and 2B, the leading ends of the outer conductors 22 are exposed with removal of the insulating coatings 21, and the leading ends of the insulation members 23 are exposed with removal of the insulating coatings 21 and the outer conductors 22. Specifically, the leading ends of the coaxial cables 2A and 2B each have the insulation member 23, the outer conductor 22, and the insulating coating 21 exposed in order from the leading end.

The coaxial connector 3 allows the coaxial cables 2A and 2B to be connected thereto in parallel. In the present embodiment, the coaxial connector 3 is an L-shaped coaxial connector. The coaxial connector 3 includes an internal terminal 31, an insulation member 32, and an external terminal (also referred to as a housing) 33.

Figure 3:
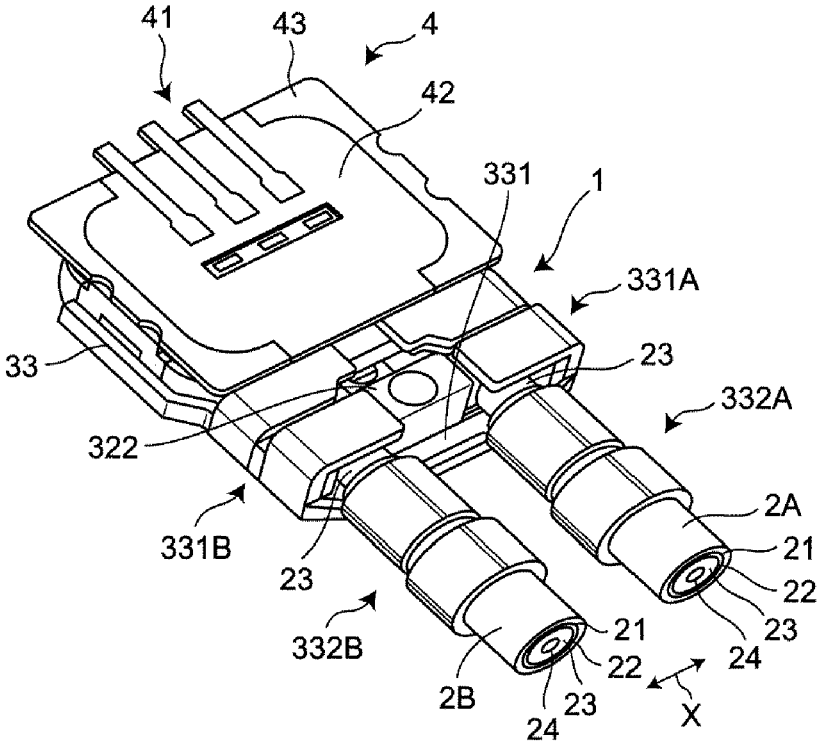
FIG. 3 is a perspective view of a counterpart connector fitted to the coaxial connector incorporating coaxial cables of FIG. 1.

As illustrated in FIG. 3, the coaxial connector 3 is detachably fitted to a counterpart connector (also referred to as a receptacle) 4. The counterpart connector 4 is mounted on, for example, a circuit board such as a printed circuit board. The counterpart connector 4 includes a central conductor 41 connectable to the internal terminal 31, an insulation member 42, and an outer conductor 43 connectable to the external terminal 33. The insulation member 42 is disposed between the central conductor 41 and the outer conductor 43, and functions to electrically insulate the central conductor 41 and the outer conductor 43 from each other.

The internal terminal 31 is a terminal connectable to the central conductor 24 of each of the coaxial cables 2A and 2B. In the present embodiment, the internal terminal 31 is formed from multiple bent metal plates. The metal plates are formed from, for example, a copper alloy. The surfaces of the metal plates are plated with, for example, nickel or gold. The structure of the internal terminal 31 is not limited to a particular one, but may be any of various structures widely known thus far.

The insulation member 32 is disposed between the internal terminal 31 and the external terminal 33 to electrically insulate the internal terminal 31 and the external terminal 33 from each other. In the present embodiment, the insulation member 32 includes an upper case 321 and a lower case 322. The internal terminal 31 is held between the upper case 321 and the lower case 322. The external terminal 33 surrounds the upper case 321 and the lower case 322. The upper case 321 and the lower case 322 are formed from resin such as a liquid crystal polymer. The insulation member 32 is not limited to a particular one, and may have any of various structures widely known thus far.

The external terminal 33 is a terminal connectable to the outer conductors 22 of the coaxial cables 2A and 2B. The external terminal 33 is securely fittable to the counterpart connector 4 illustrated in FIG. 3, and functions to secure electrical connection with the ground. The external terminal 33 is formed by, for example, punching out, cutting, and bending a single metal plate (for example, phosphor bronze for a spring).

The external terminal 33 includes a holding portion 331, which holds the coaxial cables 2A and 2B, and a plurality of crimping portions 332A and 332B respectively corresponding to the coaxial cables 2A and 2B.

The holding portion 331 extends in the axial directions of the coaxial cables 2A and 2B. A portion of the upper case 321 and a portion of the lower case 322 of the insulation member 32 are disposed above the holding portion 331. The coaxial cables 2A and 2B are disposed while having the exposed portions of the insulation members 23 located above the holding portion 331. In the present embodiment, the holding portion 331 includes tabs 331A and 331B. The tab 331A holds a portion of the upper case 321, a portion of the lower case 322, and the exposed portion of the insulation member 23 of the coaxial cable 2A. The tab 331B holds a portion of the upper case 321, a portion of the lower case 322, and the exposed portion of the insulation member 23 of the coaxial cable 2B. Each of the tab 331A and the tab 331B is divided into two pieces as illustrated in FIG. 1 to FIG. 3 in the present embodiment, but may be integrated without being divided.

Figure 4:
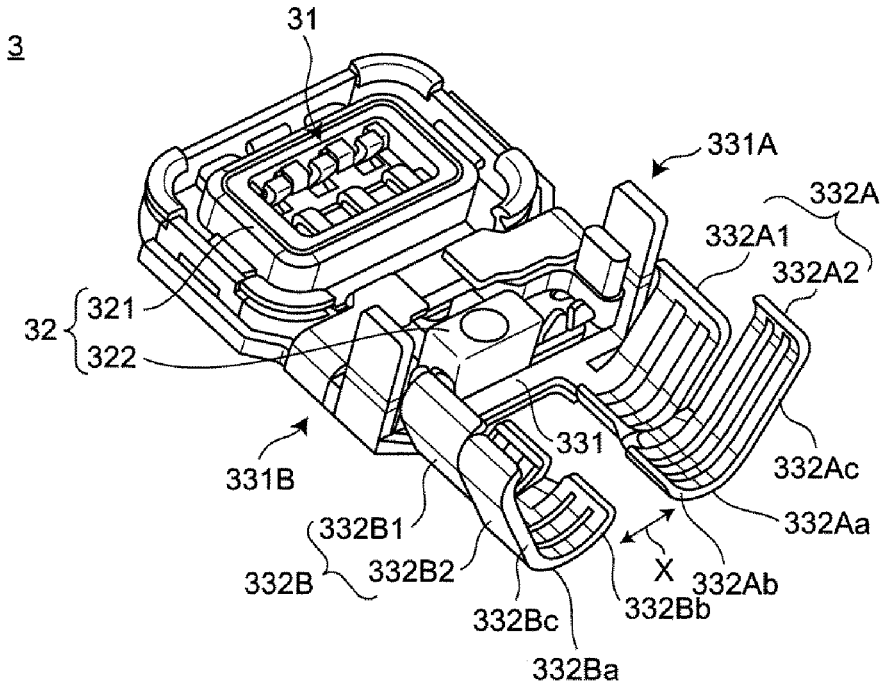
FIG. 4 is a perspective view of a schematic structure of a coaxial connector according to an embodiment of the present disclosure.

FIG. 4 is a perspective view of a schematic structure of the coaxial connector 3.

The crimping portion 332A is formed from a plate member bent to follow the outer circumference of the coaxial cable 2A. The crimping portion 332A is connected to the holding portion 331 at a bottom portion 332Aa, which is a portion between both end portions of the crimping portion 332A in an arrangement direction (also referred to as a parallel direction) X of the coaxial cables 2A and 2B. The bottom portion 332Aa is an area of the crimping portion 332A extending in the longitudinal direction of the coaxial cable 2A. Here, in the cross-sectional view (refer to FIG. 6) taken orthogonal to the longitudinal direction of the coaxial cable 2A, a virtual straight line orthogonal to the arrangement direction X and passing through the center of the coaxial cable 2A is defined as a virtual straight line L1. In addition, a point where the virtual straight line L1 and the bottom portion 332Aa, which is the connection portion connectable with the holding portion 331A, intersect is defined as a point of intersection P1. An inner hook 332Ab, extending inward in the arrangement direction X from the point of intersection P1, is shorter than an outer hook 332Ac, extending outward in the arrangement direction X from the point of intersection P1. Specifically, the inner hook 332Ab is shorter than a half of the outer circumference of the coaxial cable 2A, and the outer hook 332Ac is longer than a half of the outer circumference of the coaxial cable 2A. In the present embodiment, the total length of the inner hook 332Ab and the outer hook 332Ac is equal to the length of the outer circumference of the coaxial cable 2A. The inner hook 332Ab has a length equal to or larger than a quarter of the length of the outer circumference of the coaxial cable 2A.

In the present embodiment, the crimping portion 332A is used to crimp the outer conductor 22 of the coaxial cable 2A and to crimp the insulating coating 21 of the coaxial cable 2A. Specifically, the crimping portion 332A is divided into a tab 332A1, used to crimp the outer conductor 22 of the coaxial cable 2A, and a tab 332A2, used to crimp the insulating coating 21 of the coaxial cable 2A.

The crimping portion 332B and the crimping portion 332A, arranged in the arrangement direction X form bilateral symmetry. Specifically, the crimping portion 332B is formed from a plate member bent to follow the outer circumference of the coaxial cable 2B. The crimping portion 332B is connected to the holding portion 331 at a bottom portion 332Ba, which is a portion between both end portions of the crimping portion 332B in the arrangement direction X of the coaxial cables 2A and 2B. The bottom portion 332Ba is an area of the crimping portion 332B extending in the longitudinal direction of the coaxial cable 2B. Here, in the cross-sectional view (refer to FIG. 6) orthogonal to the longitudinal direction of the coaxial cable 2B, a virtual straight line orthogonal to the arrangement direction X and passing the center of the coaxial cable 2B is defined as a virtual straight line L2. A point of cross section where the virtual straight line L2 and the bottom portion 332Ba, which is a connection portion connectable with the holding portion 331, intersect is defined as a point of intersection P2. An inner hook 332Bb extending inward in the arrangement direction X from the point of intersection P2 is shorter than an outer hook 332Bc extending outward in the arrangement direction X from the point of intersection P2. Specifically, the inner hook 332Bb is shorter than a half of the outer circumference of the coaxial cable 2B, and the outer hook 332Bc is longer than a half of the outer circumference of the coaxial cable 2B. In the present embodiment, the total length of the inner hook 332Bb and the outer hook 332Bc is equal to the length of the outer circumference of the coaxial cable 2B. The inner hook 332Bb is longer than or equal to a quarter of the length of the outer circumference of the coaxial cable 2B.

In the present embodiment, the crimping portion 332B is used to crimp the outer conductor 22 of the coaxial cable 2B and to crimp the insulating coating 21 of the coaxial cable 2B. Specifically, the crimping portion 332B is divided into a tab 332B1, used to crimp the outer conductor 22 of the coaxial cable 2B, and a tab 332B2, used to crimp the insulating coating 21 of the coaxial cable 2B.

Figure 5A:
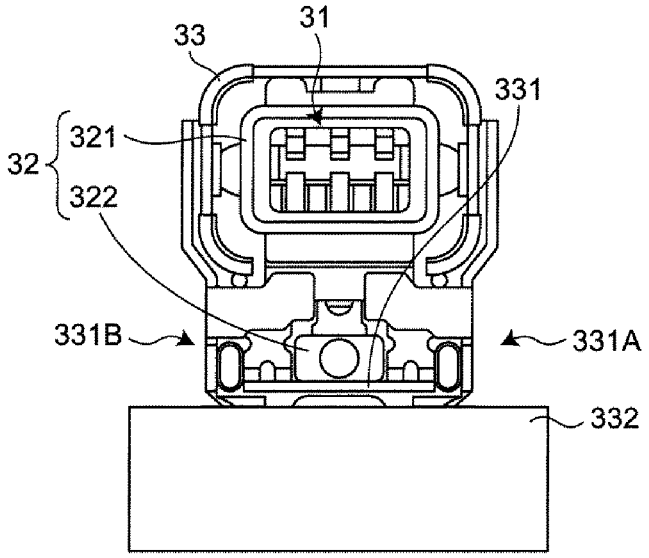
FIG. 5A is a plan view of an example of a method for manufacturing a crimping portion included in the coaxial connector of FIG. 4.
Figure 5B:
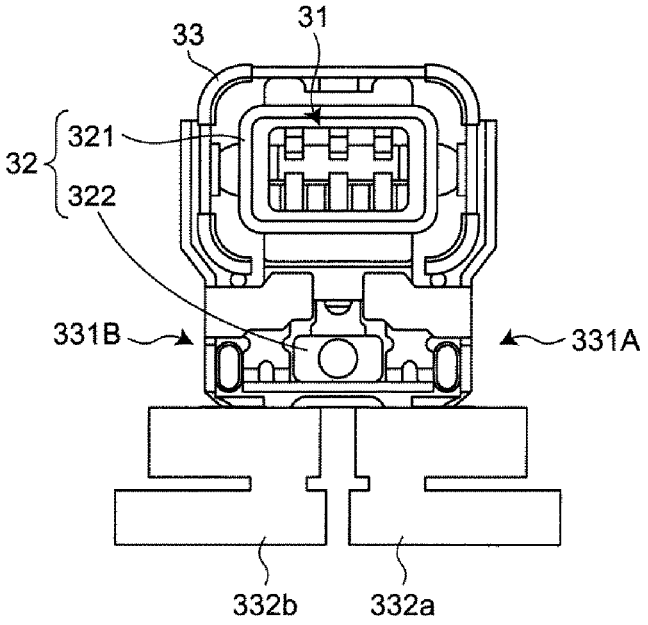
FIG. 5B is a plan view illustrating a step following the step in FIG. 5A.
Figure 5C:
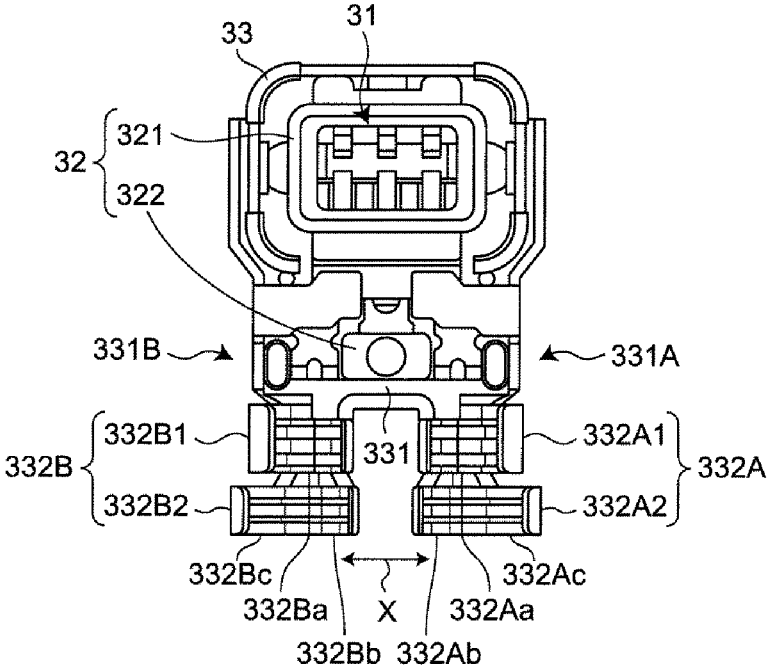
FIG. 5C is a plan view illustrating a step following the step in FIG. 5B.

Now, with reference to FIG. 5A to FIG. 5C, an example of a method for manufacturing the crimping portions 332A and 332B will be described. FIG. 5A to FIG. 5C are plan views of an example of a method for manufacturing the crimping portions 332A and 332B.

First, as illustrated in FIG. 5A, a plate member 332 (flat plate) connected to the holding portion 331 of the external terminal 33 is prepared. The plate member 332 may be integrated with the holding portion 331.

Subsequently, as illustrated in FIG. 5B, the plate member 332 is punched out or cut to form plate members 332*a* and 332*b*, corresponding to the development shapes of the crimping portions 332A and 332B.

Subsequently, as illustrated in FIG. 5C, the plate members 332*a* and 332*b* are bent to form the crimping portions 332A and 332B.

Figure 6:
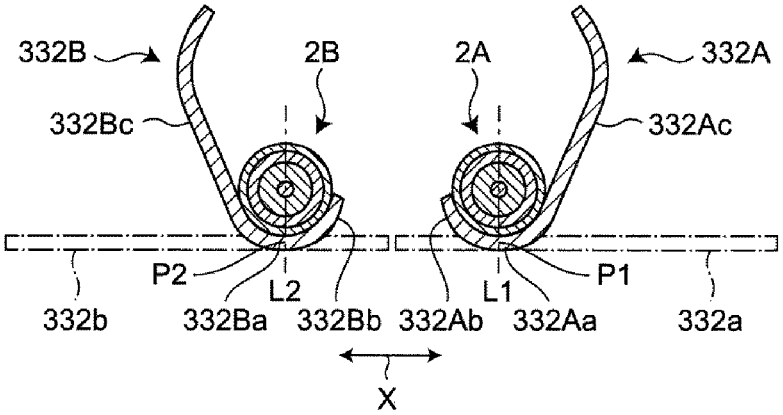
FIG. 6 is a cross-sectional view of coaxial cables disposed in the crimping portions included in the coaxial connector of FIG. 4.
Figure 7:
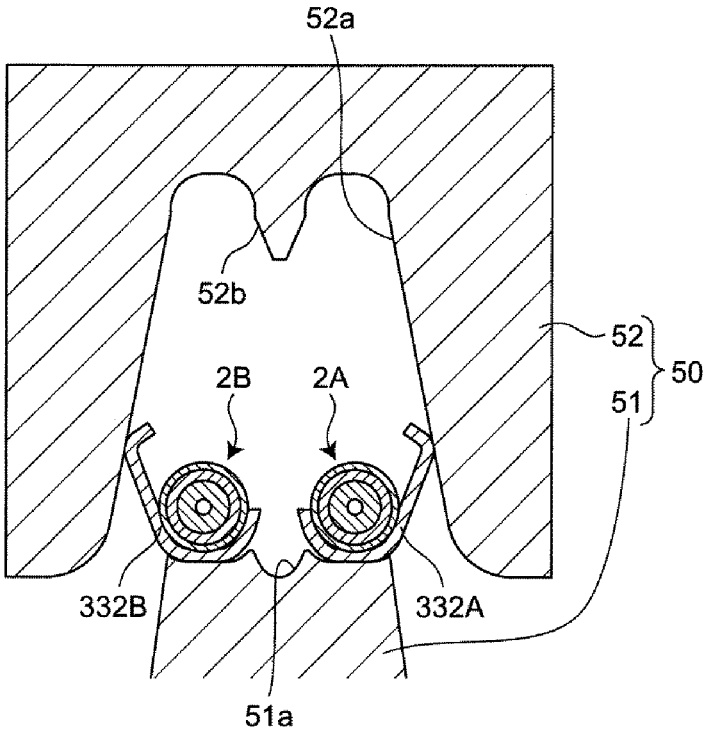
FIG. 7 is a cross-sectional view of the crimping portions included in the coaxial connector of FIG. 4 placed in a crimping device.
Figure 8:
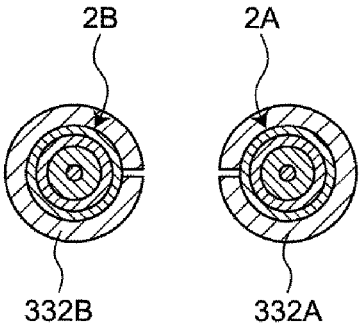
FIG. 8 is a cross-sectional view of the crimping portions included in the coaxial connector of FIG. 4 crimping the coaxial cables.

Subsequently, with reference to FIG. 6 to FIG. 8, an example of an operation where the crimping portions 332A and 332B crimp the coaxial cables 2A and 2B will be described. FIG. 6 to FIG. 8 are cross-sectional views of an example of an operation where the crimping portions 332A and 332B crimp the coaxial cables 2A and 2B.

Firstly, as illustrated in FIG. 6, the coaxial cable 2A is placed on the inner side of the crimping portion 332A, and the coaxial cable 2B is placed on the inner side of the crimping portion 332B.

Subsequently, as illustrated in FIG. 7, the crimping portions 332A and 332B are placed in a crimping device 50. The crimping device 50 includes an anvil 51 and a crimper 52. The anvil 51 has a substantially isosceles trapezoidal cross section, and has a recess 51*a* at the top. The crimping portions 332A and 332B are placed on the top of the anvil 51 at opposing positions across the recess 51*a*. The crimper 52 has a groove 52*a* having a shape corresponding to the anvil 51, and has a protrusion 52*b*, corresponding to the recess Ma of the anvil 51, at the top.

Subsequently, the anvil 51 and the crimper 52 are enclosed in a die set with the protrusion 52*b* of the crimper 52 being inserted into the recess 51*a* of the anvil 51. At this time, the outer hook 332Ac of the crimping portion 332A slides along the inner surface of the groove 52*a* of the crimper 52 to be bent to follow the outer circumference of the coaxial cable 2A. Similarly, the outer hook 332Bc of the crimping portion 332B slides along the inner surface of the groove 52*a* of the crimper 52 to be bent to follow the outer circumference of the coaxial cable 2B.

Thus, as illustrated in FIG. 8, the crimping portion 332A winds itself around the coaxial cable 2A to crimp the coaxial cable 2A, and the crimping portion 332B winds itself around the coaxial cable 2B to crimp the coaxial cable 2B.

The coaxial connector 3 according to the present embodiment thus allows the coaxial cables 2A and 2B to be connected thereto in parallel. The inner hook 332Ab of the crimping portion 332A is shorter than the outer hook 332Ac, and the inner hook 332Bb of the crimping portion 332B is shorter than the outer hook 332Bc. Thus, the space between the crimping portions 332A and 332B can be reduced. Thus, the size increase of the coaxial connector 3 can be suppressed. For example, when the coaxial cables 2A and 2B have a diameter of 0.5 mm, the distance between the centers of the coaxial cables 2A and 2B can be determined as being approximately 1.1 mm.

In the coaxial connector 3 according to the present embodiment, the inner hook 332Ab is shorter than a half of the outer circumference of the coaxial cable 2A, and the outer hook 332Ac is longer than a half of the outer circumference of the coaxial cable 2A. In this structure, as illustrated in FIG. 8, in the state where the crimping portion 332A has crimped the coaxial cable 2A, the free end portion of the inner hook 332Ab and the free end portion of the outer hook 332Ac are located on the inner side of the virtual straight line L1 in the arrangement direction X of the coaxial cables 2A and 2B. As described above, a space between the crimping portions 332A and 332B adjacent to each other can be reduced. This structure can prevent the free end portion of the inner hook 332Ab or the free end portion of the outer hook 332Ac from becoming caught on something and from cancelling crimping.

In the coaxial connector 3 according to the present embodiment, the inner hook 332Ab is longer than or equal to a quarter of the outer circumference of the coaxial cable 2A. In this structure, the inner hook 332Ab and the outer hook 332Ac allow for the diameter of the coaxial cable 2A. Thus, to fix the coaxial cable 2A using the crimping portion 332A, this structure can restrict the lateral (arrangement direction X) movement of the coaxial cable 2A, and facilitate manufacture of the coaxial connector 3.

In the coaxial connector 3 according to the present embodiment, the total length of the inner hook 332Ab and the outer hook 332Ac is equal to the length of the outer circumference of the coaxial cable 2A. In this structure, the contact area between the coaxial cable 2A and the crimping portion 332A can be increased and the coaxial cable 2A can be held more highly reliably. The crimped coaxial cable 2A eliminates the need of excessively compressing the coaxial cable 2A and deforming the cross-sectional shape, and thus prevents the characteristic impedance from varying due to deformation of the cross-sectional shape of the coaxial cable 2A and prevents electric characteristics from being lowered. Herein, "equal" includes the meaning of substantially equal besides being completely equal in view of, for example, manufacturing tolerance.

In the coaxial connector 3 according to the present embodiment, the inner hook 332Ab of the crimping portion 332A and the inner hook 332Bb of the crimping portion 332A are disposed adjacent to each other. In this structure, the space between the crimping portions 332A and 332B can be further reduced, so that the size increase of the coaxial connector 3 can be further prevented.

In the coaxial connector 3 according to the present embodiment, the crimping portion 332A crimps the outer conductor 22 with the tab 332A1. In this structure, the external terminal 33 and the outer conductor 22 of the coaxial cable 2A can be securely electrically connected to each other through the crimping portion 332A.

In the coaxial connector 3 according to the present embodiment, the crimping portion 332A also crimps the insulating coating 21 with the tab 332A2. In this structure, the contact area between the coaxial cable 2A and the crimping portion 332A can be increased and the coaxial cable 2A can be held more highly reliably.

In the coaxial connector 3 according to the present embodiment, the crimping portion 332B and the crimping portion 332A are similarly formed (to form bilateral symmetry). Thus, the crimping portions 332B and 332A can function similarly.

The present disclosure is not limited to the above-described embodiments, and may be embodied in various other manners. For example, in the above-described structure, two coaxial cables are connected in parallel to one coaxial cable. However, the present disclosure is not limited to this structure. Three or more coaxial cables may be connected in parallel to one coaxial cable. In this case, three or more crimping portions may be disposed to correspond to the three or more coaxial cables. The crimping portion of at least one of the two coaxial cables disposed outermost in the three or more coaxial cables may have the same structure as the above-described crimping portions 332A and 332B. Also in this structure, the crimping portion can be disposed more inward in the arrangement direction by the distance by which the inner hook is shortened. Thus, the size increase of the coaxial connector 3 can be suppressed.

As illustrated in FIG. 8, for example, in the above description, the crimping portion 332A has a space between the free end portions of the inner hook 332Ab and the outer hook 332Ac in the state where the crimping portion 332A has crimped the coaxial cable 2A. The present disclosure, however, is not limited to this structure. The free end portions of the inner hook 332Ab and the outer hook 332Ac may be in contact with each other to abut against each other, or in contact with each other to overlap partially.

In the above description, as illustrated in, for example, FIG. 5C, the crimping portions 332A and 332B are bent in advance to facilitate receiving of the coaxial cables 2A and 2B. However, the crimping portions 332A and 332B are not necessarily bent.

In the above description, each of the crimping portions 332A and 332B is divided into the tabs 332A1 and 332B1 or the tabs 332A2 and 332B2. However, the present disclosure is not limited to this structure. Each of the crimping portions 332A and 332B may be formed from a single tab in which the tabs 332A1 and 332B1 or the tabs 332A2 and 332B2 are integrated.

In the above description, the coaxial connector 3 is an L-shaped coaxial connector. However, the present disclosure is not limited to this structure. The coaxial connector 3 may be, for example, a straight coaxial connector.

Figure 9:
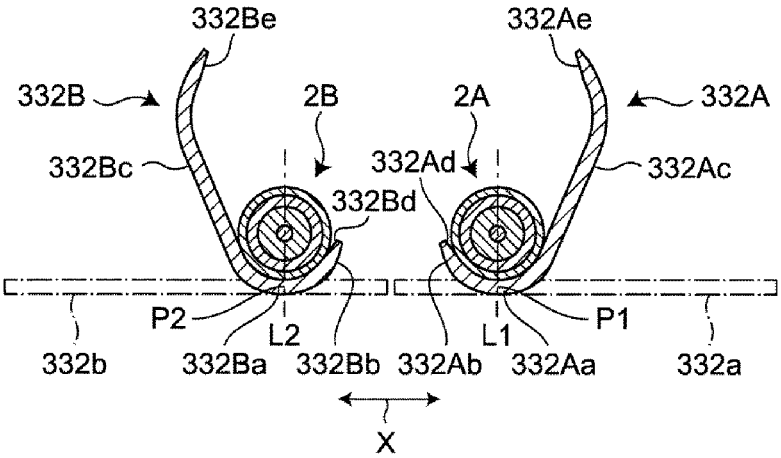
FIG. 9 is a cross-sectional view of a modification example of the crimping portions included in the coaxial connectors of FIG. 4.

In FIG. 6, the crimping portions 332A and 332B are formed from plate members having a uniform thickness. However, the present disclosure is not limited to this structure. For example, as illustrated in FIG. 9, the crimping portion 332A may include, at the free end portion of the inner hook 332Ab, an inclined portion 332Ad where the inner surface of the crimping portion facing the outer circumference of the coaxial cable 2A is inclined toward the outer surface opposite to the inner surface as it extends toward the free end portion. The crimping portion 332A may also include, at the free end portion of the outer hook 332Ac, an inclined portion 332Ae where the inner surface of the crimping portion facing the outer circumference of the coaxial cable 2A is inclined toward the outer surface opposite to the inner surface as it extends toward the free end portion. Similarly, the crimping portion 332B may include, at the free end portion of the inner hook 332Bb, an inclined portion 332Bd where the inner surface of the crimping portion facing the outer circumference of the coaxial cable 2A is inclined toward the outer surface opposite to the inner surface as it extends toward the free end portion. The crimping portion 332B may also include, at the free end portion of the outer hook 332Bc, an inclined portion 332Be where the inner surface of the crimping portion facing the outer circumference of the coaxial cable 2B is inclined toward the outer surface opposite to the inner surface as it extends toward the free end portion. The inclined portions 332Ad, 332Ae, 332Bd, and 332Ae are formed by, for example, chamfering the free end portions on the inner surfaces along the outer circumferences of the coaxial cables 2A and 2B to reduce the thickness of the crimping portions 332A and 332B. According to these structures, when the crimping portions 332A and 332B crimp the coaxial cables 2A and 2B, the coaxial cables 2A and 2B are prevented from being damaged by the free end portions of the inner hooks 332Ab and 332Bb and the outer hooks 332Ac and 332Bc.

The present disclosure fully describes preferable embodiments with reference to the attached drawings. However, various modifications or correction are apparent to persons having ordinary skill in the art. Such modifications or correction are construed as falling within the scope of the present disclosure unless departing from the scope of the present disclosure defined by the attached claims.

A coaxial connector according to the present disclosure that allows a plurality of coaxial cables to be connected thereto in parallel and suppresses the size increase is effective as, for example, a multi-contact connector.

What is claimed is:

1. A coaxial connector configured to enable a plurality of coaxial cables to connect to the coaxial connector in parallel, the coaxial cables each including a central conductor, an outer conductor surrounding the central conductor, and an insulating coating disposed between the central conductor and the outer conductor, the coaxial connector comprising:

an internal terminal connected to the central conductor of each of the plurality of coaxial cables;

an external terminal connected to the outer conductor of each of the plurality of coaxial cables, the external terminal including a holding portion that holds the plurality of coaxial cables, and a plurality of crimping portions disposed to correspond to the plurality of coaxial cables, each crimping portion being divided into a first tab that crimps the outer conductor of the corresponding coaxial cable and a second tab that crimps the insulating coating of the corresponding coaxial cable, such that one of the crimping portions corresponding to one of the coaxial cables disposed outermost in an arrangement direction of the plurality of coaxial cables is formed from a plate member bent to follow an outer circumference of the one of the coaxial cables, the one of the crimping portions includes a connection portion connectable with the holding portion at a portion between both end portions of the one of the crimping portions in the arrangement direction of the plurality of coaxial cables, and the one of the crimping portions includes an inner hook and an outer hook, the inner hook is shorter than the outer hook and extends inward in the arrangement direction from a point of intersection between the connection portion connectable with the holding portion and a virtual straight line orthogonal to the arrangement direction and passing a center of the one of the coaxial cables, in a cross-sectional view orthogonal to a longitudinal direction of the one of the coaxial cables, and the outer hook extends outward in the arrangement direction from the point of intersection; and an insulation member disposed between the internal terminal and the external terminal.

2. The coaxial connector according to claim 1, wherein the coaxial connector is configured to allow two of the coaxial cables to be connected thereto in parallel, and the inner hook of the one of the crimping portions corresponding to the one of the coaxial cables is adjacent to the inner hook of an other of the crimping portions corresponding to an other of the coaxial cables.

3. The coaxial connector according to claim 1, wherein the one of the crimping portions is disposed outermost in the arrangement direction of the plurality of crimping portions and includes, at at least one of free end portions of the inner hook and the outer hook thereof, an inclined portion where an inner surface of the one of the crimping portions facing the outer circumference of the one of the coaxial cables is inclined toward an outer surface opposite to the inner surface as the inner surface extends toward the free end portion.

4. A coaxial connector assembly comprising:

the coaxial connector according to claim 1; and the plurality of coaxial cables connected in parallel to the coaxial connector.

5. The coaxial connector according to claim 1, wherein a total length of the inner hook and the outer hook is equal to a length of the outer circumference of the one of the coaxial cables.

6. The coaxial connector according to claim 5, wherein the coaxial connector is configured to allow two of the coaxial cables to be connected thereto in parallel, and the inner hook of the one of the crimping portions corresponding to the one of the coaxial cables is adjacent to the inner hook of an other of the crimping portions corresponding to an other of the coaxial cables.

7. The coaxial connector according to claim 5, wherein the one of the crimping portions is disposed outermost in the arrangement direction of the plurality of crimping portions and includes, at at least one of free end portions of the inner hook and the outer hook thereof, an inclined portion where an inner surface of the one of the crimping portions facing the outer circumference of the one of the coaxial cables is inclined toward an outer surface opposite to the inner surface as the inner surface extends toward the free end portion.

8. The coaxial connector according to claim 1, wherein the inner hook is longer than or equal to a quarter of the outer circumference of the one of the coaxial cables.

9. The coaxial connector according to claim 8, wherein a total length of the inner hook and the outer hook is equal to a length of the outer circumference of the one of the coaxial cables.

10. The coaxial connector according to claim 8, wherein the coaxial connector is configured to allow two of the coaxial cables to be connected thereto in parallel, and the inner hook of the one of the crimping portions corresponding to the one of the coaxial cables is adjacent to the inner hook of an other of the crimping portions corresponding to an other of the coaxial cables.

11. The coaxial connector according to claim 8, wherein the one of the crimping portions is disposed outermost in the arrangement direction of the plurality of crimping portions and includes, at at least one of free end portions of the inner hook and the outer hook thereof, an inclined portion where an inner surface of the one of the crimping portions facing the outer circumference of the one of the coaxial cables is inclined toward an outer surface opposite to the inner surface as the inner surface extends toward the free end portion.

12. A coaxial connector assembly comprising:

the coaxial connector according to claim 8; and the plurality of coaxial cables connected in parallel to the coaxial connector.

13. The coaxial connector according to claim 1, wherein the inner hook is shorter than a half of the outer circumference of the one of the coaxial cables, and the outer hook is longer than the half of the outer circumference of the one of the coaxial cables.

14. The coaxial connector according to claim 13, wherein the inner hook is longer than or equal to a quarter of the outer circumference of the one of the coaxial cables.

15. The coaxial connector according to claim 13, wherein a total length of the inner hook and the outer hook is equal to a length of the outer circumference of the one of the coaxial cables.

16. The coaxial connector according to claim 13, wherein the coaxial connector is configured to allow two of the coaxial cables to be connected thereto in parallel, and the inner hook of the one of the crimping portions corresponding to the one of the coaxial cables is adjacent to the inner hook of an other of the crimping portions corresponding to an other of the coaxial cables.

17. The coaxial connector according to claim 13, wherein the one of the crimping portions is disposed outermost in the arrangement direction of the plurality of crimping portions and includes, at at least one of free end portions of the inner hook and the outer hook thereof, an inclined portion where an inner surface of the one of the crimping portions facing the outer circumference of the one of the coaxial cables is inclined toward an outer surface opposite to the inner surface as the inner surface extends toward the free end portion.

18. A coaxial connector assembly comprising:

the coaxial connector according to claim 13; and the plurality of coaxial cables connected in parallel to the coaxial connector.

* * * * *